US005134860A

United States Patent [19]

Drucker

[11] Patent Number: 5,134,860

[45] Date of Patent: Aug. 4, 1992

[54] VARIABLE AREA REFRIGERANT EXPANSION DEVICE HAVING A FLEXIBLE ORIFICE FOR HEATING MODE OF A HEAT PUMP

[75] Inventor: Alan S. Drucker, DeWitt, N.Y.

[73] Assignee: Carrier Corporation, Syracuse, N.Y.

[21] Appl. No.: 703,303

[22] Filed: May 20, 1991

[51] Int. Cl.[5] ..... F27B 41/06

[52] U.S. Cl. ..... 62/528; 62/511; 62/527; 137/513.3

[58] Field of Search ..... 62/511, 527, 528; 137/324.6, 512.1, 513.3

[56] References Cited

U.S. PATENT DOCUMENTS 3,195,579 7/1965 Bordeaux et al. ..... 62/528 X
3,642,030 2/1972 Amick ..... 62/511 X
3,877,248 4/1975 Honnold, Jr. ..... 62/511
3,952,535 4/1976 Putnam ..... 62/527 X
4,263,787 4/1981 Domingorena ..... 62/324.6
4,341,090 7/1982 Ramakrishnan ..... 62/324.6 X
4,412,432 11/1983 Brendel ..... 62/511 X
4,653,291 3/1987 Moeller et al. ..... 62/511
5,002,089 4/1991 Reedy et al. ..... 62/324.6 X
5,004,008 4/1991 Drucker ..... 62/324.6 X
5,031,416 7/1991 Drucker et al. ..... 62/527 X

*Primary Examiner*—Henry A. Bennet
*Assistant Examiner*—Christopher B. Kilner

[57] ABSTRACT

A refrigerant expansion valve meters the flow of refrigerant therethrough through a flexible orifice that increases in cross sectional area as the pressure differential across the valve increases.

14 Claims, 3 Drawing Sheets

VARIABLE AREA REFRIGERANT EXPANSION DEVICE HAVING A FLEXIBLE ORIFICE FOR HEATING MODE OF A HEAT PUMP

BACKGROUND OF THE INVENTION

1. Field of the Invention

This invention relates in general to refrigerant expansion devices used in a heat pump. More specifically, this invention relates to an expansion device that has a variable expansion area that is operated by the pressure differential existing between the high pressure and the low pressure sides of a heat pump.

2. Description of the Prior Art

A compression refrigeration system comprises a compressor, a condenser, an expansion device and an evaporator connected in a closed circuit to provide refrigeration. Hot compressed refrigerant vapor from the compressor enters the condenser, where it transfers heat to an external heat exchange medium and condenses. Condensed refrigerant, at a high pressure, flows through the expansion device, where the refrigerant undergoes a pressure drop and at least partially flashes to a vapor. The liquid-vapor mixture then flows through the evaporator where it evaporates and absorbs heat from the external surroundings. The low pressure refrigerant vapor then returns to the compressor to complete the circuit.

Although the expansion device is often of simple construction, its role in the refrigeration system is crucial. Ideally, the expansion device should meter refrigerant in a manner such that refrigerant leaving the evaporator is super-heated by a controlled, relatively small amount. The foregoing is desired to prevent any damaging liquid refrigerant from entering the compressor, and to avoid subjecting the compressor to excessive temperatures from highly super-heated vapor.

The performance of the expansion device plays an important role not only in protecting the compressor, but also in determining the cooling capacity of the refrigeration system. Since the system is a closed circuit, any effect the device has on the low or evaporator side is intimately tied in with the performance of the high or condenser side. Most conventional air conditioning systems incorporating compression refrigeration units of the kind described are designed to have a predetermined cooling capacity at a given ambient temperature. The capacity of the system usually decreases at ambient temperatures above the design point. The decrease in capacity of the system at temperatures above the design point has a direct effect on the requirements related to the type of expansion device.

Among the most commonly used expansion devices are thermostatic expansion valves, capillary tubes and other fixed orifice devices. Thermostatic expansion valves control the flow rate of liquid refrigerant entering the evaporator as a function of the temperature of the refrigerant gas leaving the evaporator. This control is achieved by varying the cross-sectional area through a needle type valve contained within the valve body. The needle is typically joined to a flexible metal bellows or diaphragm which is, in turn, actuated by a non-heat conducting rod connected at its other end to a sealed bellows. The sealed bellows, in turn, is joined to a thermostatic sensing bulb by means of a capillary tube. This bulb provides the feedback to the valve of the temperature of the refrigerant leaving the evaporator and the valve responds by increasing or decreasing the flow of refrigerant through the needle valve according to this temperature. While being highly efficient in their operation and readily responsive to changes in load upon the system to vary the flow of refrigerant to the evaporator, thermostatic expansion valves are also complicated and relatively expensive. Further, in split system type air conditioning systems, wherein the compressor and condenser are located outside at a remote location from the evaporator, the distance of the sensing bulb from the compressor result in less than optimum conditions in such systems.

Capillary tubes are generally used in place of thermostatic expansion valves, particularly in smaller applications, wherein ambient air is almost universally utilized as the condensing medium. Although capillary tubes are relatively inexpensive to manufacture and are simple to install, they have some serious operating limitations, particularly when they are operating at conditions above or below the design point of the system.

As an example, as the outdoor ambient temperature increases there is an increase in the pressure differential across the expansion device and the compressor. At higher pressure ratios the compressor pumps a lower flow rate, however, a capillary type expansion device at such higher pressure ratio passes a higher flow rate. This flow imbalance results in the loss of stored subcooled liquid refrigerant from the high side and loss of superheat and flooding of the low side. These phenomenon greatly reduce system efficiency and performance.

An additional problem is found at relatively low ambient temperatures, wherein the pressure differential across the expansion device is of a relatively small magnitude. Under these conditions the subcooling of the refrigerant entering the expansion device increases as the outdoor ambient temperature falls, leading to more refrigerant being stored in the condenser, which starves the evaporator. As a result, more of the evaporator becomes filled with superheated vapor and the superheat leaving the evaporator increases. Using increased evaporator surface to superheat refrigerant is not putting the surface to its most effective use.

Another known fixed orifice expansion device is the orifice plate. Very simply an orifice plate comprises a thin plate having an expansion orifice extending therethrough. Orifice plates are small and inexpensive, but they are erratic in performance. Hence, such plates are not in wide use.

In an attempt to provide an alternate expansion device, having the economical advantages of the capillary tube, while being small and more efficient in operation, the expansion device described in commonly assigned U.S. Pat. No. 3,642,030 entitled "Refrigerant Throttling Device" and issued on Feb. 15, 1972 in the name of Larry D. Amick was developed. That device comprises a body member having a tubular insert having prescribed length-to-bore diameter ratios, a conical inlet, and a conical exit.

Continuing efforts to develop an economical, efficient and effective fixed orifice expansion device resulted in the development of the expansion device described in commonly assigned U.S. Pat. No. 3,877,248 entitled "Refrigerant Expansion Device" which was issued Mar. 1, 1974 in the name of Fred V. Honnold, Jr. That device comprises a body having an expansion conduit extending therethrough with a flat entrance presenting a sharp edge orifice to incoming refrigerant. The sharp edge entrance orifice effects a major portion of the refrigerant pressure drop at the entrance, so that only a short conduit length is necessary to effect the balance of the pressure drop demanded of the device. The body member is incorporated in a unitary coupling member configured to join refrigerant lines from the condenser to the evaporator.

Commonly assigned U.S. Pat. No. 3,992,898 entitled "Moveable Expansion Valve" which issued Nov. 23, 1976, in the name of Richard J. Duell and John A. Ferrel represents a further refinement of a fixed orifice expansion device. In the device of this patent, the refrigerant metering port is formed in a free floating piston which is mounted within a chamber. When refrigerant flows through this device in one direction, the free floating piston moves to one position wherein the refrigerant flow is through the metering port thereby serving as an expansion device. When refrigerant flows through this device in the opposite direction, the free floating piston moves to a second position wherein refrigerant is allowed to flow through a number of flow channels formed in the outer peripheral surface of the piston to thereby allow substantially unrestricted flow through the device. This arrangement allows such a device to be used, in combination with a second expansion device of the same design, in a heat pump system to allow the desired expansion of the refrigerant through the system flowing in both the cooling and heating directions.

In a cooling only system the expansion device of the '898 patent allows a system to be adjusted as to the amount of refrigerant superheat and other expansion parameters by changing the piston contained within the valve body in the field. The piston usually is changed to match the diameter of the metering port, running the length of the piston, with the requirements of a particular system to optimize performance.

U.S. Pat. No. 4,263,787, issued to the assignee hereof, entitled "Expansion Device with Adjustable Refrigerant Throttling" which issued Apr. 28, 1981 to Albert A. Domingorena relates to an improvement of the device of the '898 patent which allows adjusting the diameter of the metering port without having to break into the refrigeration circuit of the system to change the piston.

Summing up the state of the prior art, thermostatic expansion valves, while being highly efficient in their operation and readily responsive to change in load upon the system to vary the flow of refrigerant to the evaporator, are complicated, expensive, and have drawbacks in certain applications. For this reason they are generally not employed in small applications. As a result, capillary tubes or other fixed orifice expansion devices are generally used in such small applications. Such devices are relatively inexpensive, however, as discussed above, they have operating limitations at both high and low ambient temperatures.

From the foregoing, it is evident that the need exists for a refrigerant expansion device which is inexpensive to manufacture and which is effective in performance over a wide range of operating conditions.

One approach to solving this problem has been to design a refrigerant flow metering device which has a flow metering passage which varies in cross-section in response to changes between the high and low side pressures in the refrigeration system. One such device is described in U.S. Pat. No. 4,341,090 entitled "Variable Orifice Metering" issued on Jul. 27, 1982.

As discussed above in connection with the '898 patent and the '090 patent, it is common practice to use two expansion devices in a heat pump system. One expansion device is dedicated to metering refrigerant in the cooling mode of operation, while the other device allows free bypass flow. Likewise, the other expansion device is dedicated to metering in the heating mode, during which time the cooling expansion device allows free bypass flow. In such a system, the expansion area of the heating expansion device is, as a rule, smaller than the expansion area of the cooling expansion device.

This sizing reflects the operating conditions experienced by the system during the cooling and heating modes of operation. Several examples of problems encountered with a cooling refrigeration system at outdoor temperature extremes were given previously. The problems experienced by a refrigeration system in the heating mode of operation are different, and an appreciation of this facilities an understanding of why an expansion device optimized for the heating mode is desirable.

As an example of the above, in the heating mode of operation, as the outdoor ambient temperature increases there is an increase in the pressure differential across the expansion device and an accompanying increase in flow rate. However, the decreased pressure ratio across the compressor results in an increased flow rate pumped by the compressor. As a result, at times, the evaporator will be starved and the evaporator becomes filled with superheated vapor and the superheat leaving the evaporator increases. Using increased evaporator surface to superheat refrigerant is not putting the surface to its most effective use. The problems associated with this are well known and have been pointed out hereinabove.

An additional problem, in the heating mode, is found at relatively low ambient temperatures, wherein the pressure differential across the system is of a relatively small magnitude but the pressure ratio is high which results in a low flow through the expansion device while the compressor is pumping a low flow rate, which floods the evaporator. As a result, more of the evaporator becomes filled with liquid as it passes from the evaporator to the compressor. The problems associated with this condition are well known and have been pointed out hereinabove.

As a general rule, when a heat pump is operating in the heating mode of operation, it is desirable that the refrigerant flow rate be greater at high evaporator pressures (as a result of high outdoor ambient temperature). While as the evaporator pressure decreases (as a result of decreasing outdoor ambient temperature), refrigerant flow rate is reduced and thus a smaller flow metering area is desired. Such decreased refrigerant flow rate is commensurate with the lower compressor pumping rate at the lower evaporator pressure.

It is accordingly deemed desirable to have a variable area expansion device which is capable of responding to the available system conditions which will allow the device to vary the flow metering passage in accordance with the above noted requirements of a heat pump during the heating mode of operation.

SUMMARY OF THE INVENTION

It is an object of the present invention to meter the flow of refrigerant through a refrigerant expansion device as a function of the pressure differential between the high and low pressure side of a refrigeration system.

It is another object of the present invention to meter the flow of refrigerant in a refrigerant expansion device such that a reduced flow is achieved at low ambient temperatures and an increased flow is allowed at higher ambient temperatures.

It is a further object of the present invention to provide a refrigerant expansion device wherein the flow metering passage is formed in an elastomeric element and the elastomeric element deforms in response to an increased pressure differential across the expansion device to increase the size of the flow metering passage.

It is related object of the present invention to achieve these and other objects with a simple, safe, economical and reliable expansion device.

These and other objects of the present invention are achieved by an expansion device for metering the flow of refrigerant between the high and low pressure sides of a refrigeration system which has a housing having a flow passage extending therethrough. The device includes a flow metering element which has an outer wall and a flow metering passage extending longitudinally therethrough. The flow metering passage is defined by the inner wall of the flow metering element and by inlet and outlet openings at opposite ends of the flow metering element. The flow metering element is formed from an elastomeric material. Means are provided for supporting the flow metering element with respect to the flow passage of the housing with the inlet opening of the flow metering element in fluid communication with the high pressure side of the refrigeration system. The outer wall of the flow metering element and the outlet opening of the flow metering element are supported in fluid communication with the low pressure side of the refrigeration system. The elastomeric flow metering element is configured so that it deforms in response to an increase in pressure differential between the high and low pressure sides of the refrigeration system to increase the size of the flow metering passage therethrough.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will best be understood from the following description of the preferred embodiments when read in connection with the accompanying drawings wherein like numbers have been employed in the different figures to denote the same parts, and wherein;

DESCRIPTION OF THE PREFERRED EMBODIMENTS

Figure 1:
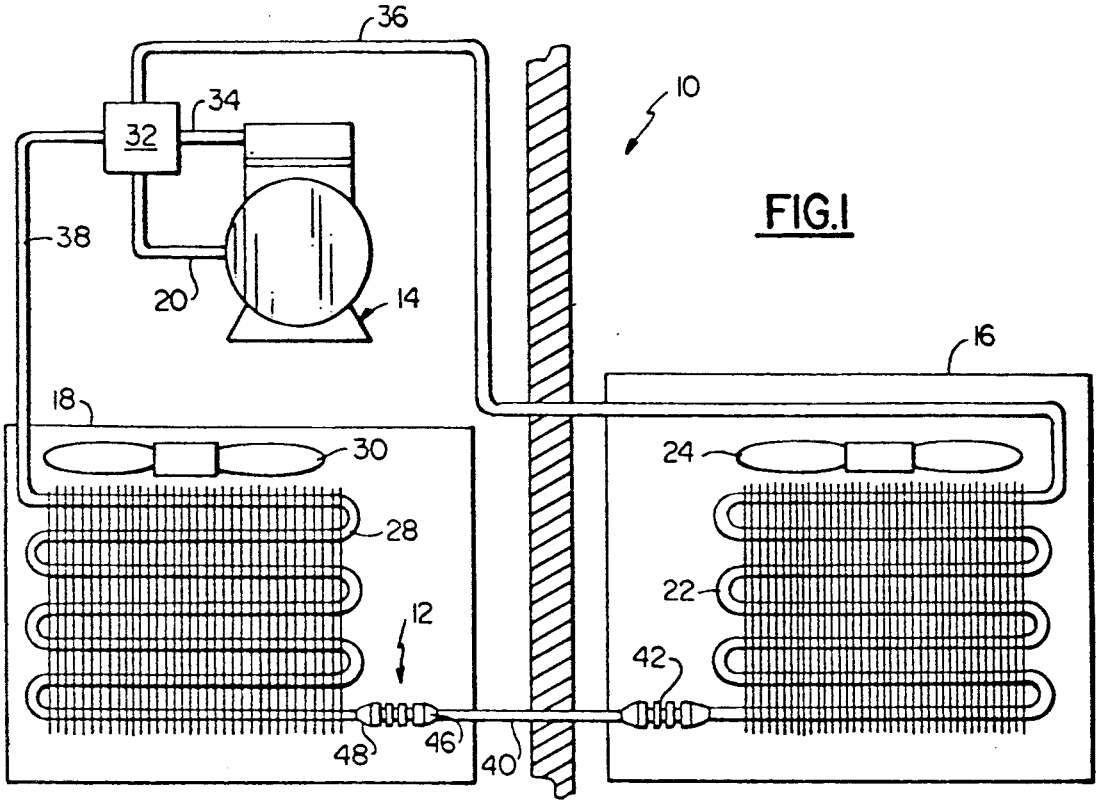
FIG. 1 is a diagrammatic representation of a heat pump system capable of being thermodynamically reversed to provide either heating or cooling, this system contains a heating expansion device according to the present invention.

With reference first to FIG. 1, numeral 10 designates a heat system of substantially conventional design which incorporates a variable area expansion valve 12 according to the present invention. The heat pump 10 includes a compressor 14, an indoor heat exchanger assembly 16 and an outdoor heat exchanger assembly 18. The indoor heat exchanger 16 includes a refrigerant-to-air heat exchange coil 22 and an indoor fan 24. The outdoor heat exchanger assembly 18 includes a refrigerant-to-air heat exchange coil 28 and an outdoor fan 30. The indoor and outdoor heat exchanger assemblies 16 and 18 are of conventional design and will not be described further herein.

A four way reversing valve 32 is connected to the compressor discharge port by a refrigerant line 34, to the compressor suction port by a refrigerant suction line 20, and, to coils 22 and 28 by refrigerant lines 36 and 38 respectively. The reversing valve of 32 is also of a conventional design for directing high pressure vapor from the compressor to either the indoor coil 22, in the heating mode of operation or, during the cooling mode and defrost mode, to the outdoor coil 28. Regardless of the mode of operation, the reversing valve 32 serves to return refrigerant from the coil which is operating as an evaporator to the compressor by way of suction line 20.

A refrigerant line 40 interconnects the indoor heat exchanger coil 22 and the outdoor heat exchanger 28. A variable area expansion valve 12, according to one of the embodiments of the present invention, is located in the line 40, within the outdoor heat exchanger 18 adjacent to the outdoor coil 28. An expansion device 42 dedicated to the cooling mode of operation is located at the other end of the refrigerant line 40, within the indoor heat exchange assembly 16, adjacent to the indoor coil 22. The cooling expansion device 42 is preferably of the type that meters the flow of refrigerant therethrough when it is flowing through the valve towards the indoor coil 22 and freely bypasses the flow of refrigerant in the other direction therethrough. The cooling expansion device 42 could be of the type described in the above discussed U.S. Pat. No. 3,992,898 and will not be further described herein. The structure of the several embodiments of the variable area expansion valve 12 will now be described in detail followed by a description of the valves in their cooling and bypass modes of operation.

Turning first to FIGS. 2-8, a first embodiment of the expansion valve 12 comprises a generally cylindrical housing 44 having a male thread formed at each end thereof which is adapted to mate with female connectors, 46 and 48 (FIG. 1) associated with the refrigerant line 40 to create a fluid tight joint therebetween. A flow passage 50, which is axially aligned with the housing body, passes into the body from the left hand side of the expansion device as viewed in FIGS. 2, 5 and 8. The diameter of the flow passage 50 is substantially equal to or greater than the internal opening of the supply line 40, and, thus is capable of supporting the flow passing therethrough without restriction. The flow passage 50 opens into an expansion chamber 52, bored or otherwise machined into the opposite end of the housing body. The transition from the flow passage 50 to the expanded chamber 52 defines a right hand facing shoulder or end wall 53. The open right hand end of the chamber 52 is provided with a nipple 54 which is press-fitted therein and which contains a tapered internal opening 56, which narrows down to the diameter of the internal opening of supply line 40. An 'O' ring 58 is carried within an annular groove 60 formed about the outer periphery of the nipple, which serves to establish a fluid tight seal between the internal wall of the chamber 52 and the nipple 54.

Figure 2:
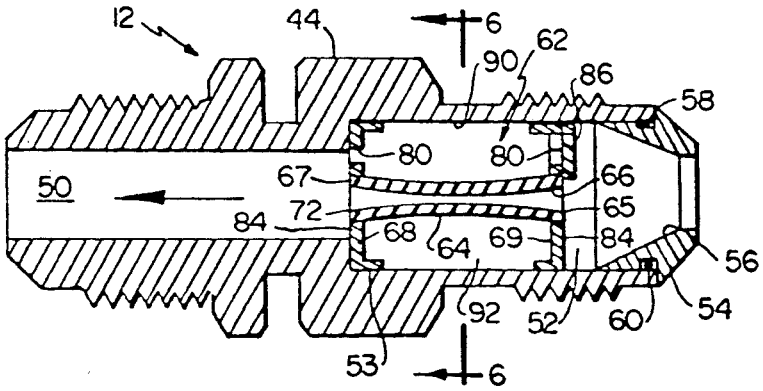
FIG. 2 is a longitudinal sectioned view through a variable area heating expansion device according to one embodiment of the present invention.

A flow metering piston assembly 62 is slideably mounted within the expanded chamber 52. The flow metering piston assembly 62 includes a longitudinally extending flow metering element 64 having a flow metering passage 66 extending longitudinally therethrough. As best shown in FIG. 2 the flow metering passage 66 is somewhat hourglass shaped in that its undeformed cross-sectional area varies from a minimum near its center to maximum values at its inlet opening 65 and outlet opening 67. The flow metering element 64 is supported within the chamber 52 by a pair of support and guide discs 68 and 69 which are attached to the flow metering element at the outlet and inlet ends thereof, respectively.

Figure 3:
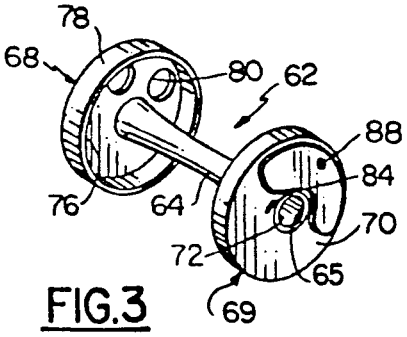
FIG. 3 is a perspective showing of the flow metering element of the device of FIG. 2.
Figure 4:
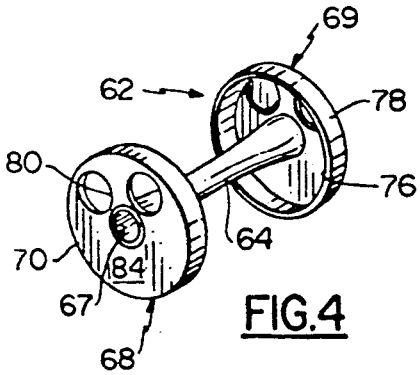
FIG. 4 is a perspective view similar to FIG. 3 showing the other end of the flow metering element.

As best seen in FIGS. 3 and 4, the discs 68 and 69 include a circular planar portion 70 having a centrally located opening 72 therethrough for receiving and supporting the outlet and inlet ends, 67, 65 respectively of the flow metering elements 64. Each of the support discs 68 and 69 has an annular skirt like portion 76 extending from the outer periphery of the circular portions 70 thereof. Each of the skirts 76 defines a peripherally extending outwardly facing surface 78.

Each of the planar circular portions 70 of the guide discs 68 and 69 also include a pair of flow openings 80 formed therein. In the preferred embodiment the flow metering element 64 of the piston assembly 62 is made from a thermo setting material. The thermo setting material is preferably formed in a mold which allows it to be cast directly to the openings 72 in the support discs 68 and 69 to thereby assure a fluid tight seal therebetween. In the illustrated embodiment a thin layer of the thermo-setting material is also deposited on the axially outer facing end surface 84 of the circular portions 70 of the support discs 68 and 69 respectively, as well as on the outer peripheral surfaces 78 of the skirts 76. The material is elastomeric in nature and is preferably a synthetic rubber which will remain dimensionally stable in a refrigerant environment.

As best shown in FIG. 3 the right hand facing end 84 of the right hand support disc 69 has a substantially kidney shaped flapper valve 86 attached thereto. The valve is positioned in over lying relationship with the pair of flow openings 80. The flapper valve 86 is attached to the disc 69 preferably by a rivet 88 near the outer periphery of the disc. The flapper valve 86 is preferably made from teflon or other suitable flexible material that will enable it to sealingly engage the elastomeric coating on the outer end 84.

Referring again collectively to FIGS. 2-8, it will be noted that when the flow metering piston assembly 62 is mounted within the chamber 52 the outer peripheral surfaces 78 of the support discs 68 and 69 are adapted to define a substantially fluid tight sealing relationship with the inner wall 90 of the chamber 52.

In operation, the variable area expansion valve 12 is installed in the refrigerant liquid line 40 in a system as shown in FIG. 1 to meter refrigerant as it moves, at high pressure, from heat exchanger 22, serving as a condenser coil, to heat exchanger 28, at low pressure, serving as an evaporator. Under the influence of flowing refrigerant, the piston assembly 62 is moved to the left to the position illustrated in FIG. 2. With the piston assembly in this position the left hand end face 84 of the disc 68 is in positive engagement with the right hand facing end wall 53 of the chamber 52. As so positioned and engaged the flow metering assembly 62 cooperates with the enlarged chamber 52 to define an annular chamber 92 therebetween. FIG. 2 illustrates the valve 12 in a condition representing a relatively low pressure differential between the high and low pressure sides of the system. As shown, the high pressure portion of the refrigeration system comprises the portion of the valve to the right of the right hand support disc 69. High pressure thus is in fluid communication with the inlet opening 65 to the flow metering passage 66 to allow the metering of refrigerant through the passage. It will be noted that in this condition the flapper valve 86 is caused to sealingly engage the axial outer end 84 of the support disc 69 to thereby prevent flow of high pressure refrigerant through the openings 80 which are covered by the valve 86. At the same time the pressure of the low pressure side of the refrigeration system exists in the flow passage 50 to the left of the support disc 68 and also exists within the annular chamber 92 as a result of the fluid communication of the low pressure side through the flow openings 80 in the support disc 68.

Figure 5:
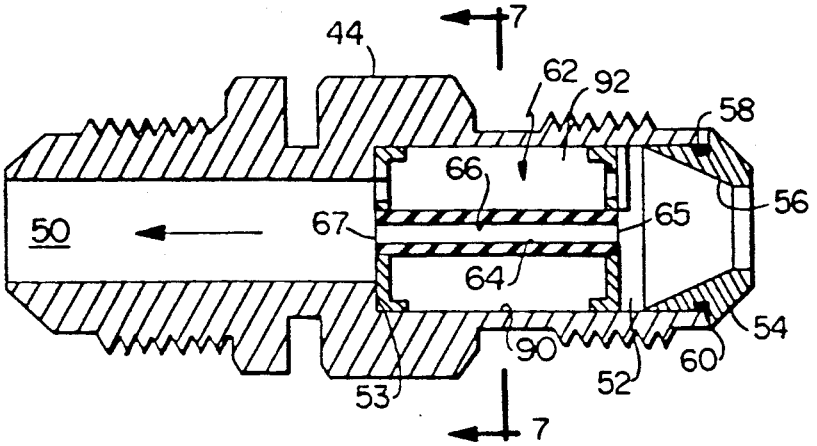
FIG. 5 is a longitudinal sectional view of the expansion device of FIG. 2 showing operation of the device while in the heating mode of operation.
Figure 6:
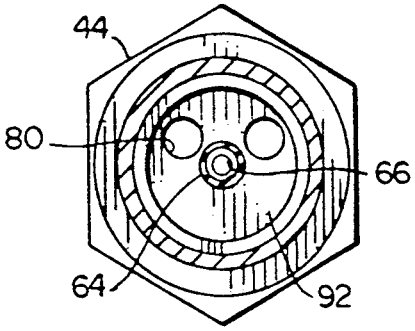
FIG. 6 is a sectional view of the first embodiment of the expansion device taken along the lines 6—6 of FIG. 2.
Figure 7:
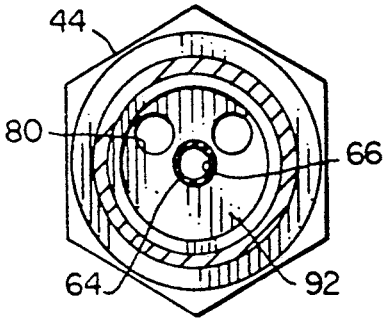
FIG. 7 is a sectional view of the first embodiment of the expansion device taken along the lines 7—7 of FIG. 5.

As a result of this arrangement as the pressure differential of the system increases the pressure within the flow metering passage 66 becomes increasingly larger than the pressure within the annular chamber 92. As a result, because of the elastomeric properties of this element, and the initial hour-glass shaped configuration of the flow metering element 64 the element is caused to expand outwardly to thereby increase the effective cross sectional area of the flow metering passage 66 extending therethrough. FIG. 5 represents the variable area expansion valve 12 in operation at a relatively high system pressure differential. Comparison of FIG. 5 and 7 (high pressure differential) to FIGS. 2 and 6 (low pressure differential) makes clear the substantially increased metering area through the valve during high pressure differential operation.

Figure 8:
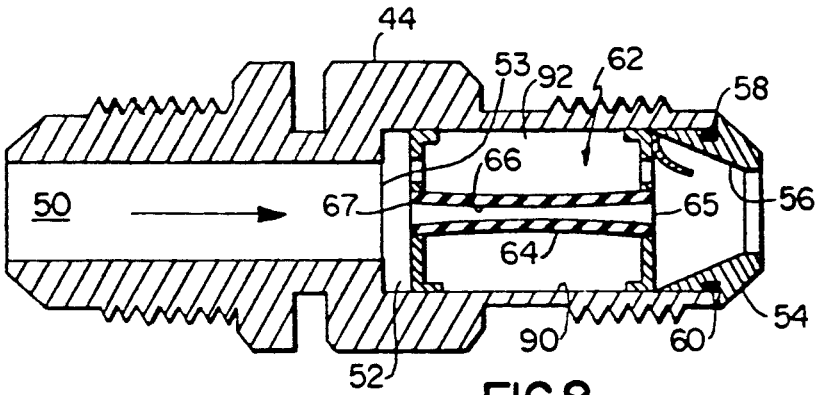
FIG. 8 is a longitudinal sectional view of the first embodiment of the expansion device showing the device in the by-pass mode of operation.

Referring now to FIG. 8, when the refrigeration cycle is reversed and refrigerant is caused to flow through the system in the opposite direction, the flow metering piston assembly 62 will automatically move to the position illustrated in FIG. 8, resting against the nipple 54. With the piston in this position there are two paths for refrigerant to flow through the valve past the flow metering element 64. A first path is through the flow metering passage 66, and, the second substantially larger cross sectional area path is through the flow openings 80 in the support disc 68 into the annular chamber 92, and, from the chamber, through the flow openings 80 in the right hand support disc 69. These openings, which, as seen in the drawing, are now free to allow refrigerant flow with the flapper valve 86 forced to move open by the flow of refrigerant there past. As a result the flow through the valve 12 in this condition is substantially unrestricted around and through the metering assembly 62, to the downstream refrigerant line 40.

Turning now to FIGS. 9-12, a second embodiment of the expansion valve is identified as 12A and comprises a generally cylindrical housing 94 having a male thread formed at each end thereof which is adapted to mate with female connectors 46 and 48 (FIG. 1) associated with the refrigerant line 40 to create a fluid tight connection therebetween. A flow passage 96, which is axially aligned with the housing body passes into the body from the left hand end of the expansion device as viewed in FIGS. 9, 11 and 12. The diameter of the flow passage 96 is substantially equal to or greater than the opening of the supply line 40 and thus is capable of supporting the flow passing therethrough without restriction. The flow passage 96 opens into an expanded chamber 98, bored, or otherwise machined into the housing body. The transition from the flow passage 50 to the expanded chamber 98 defines a right hand facing shoulder or end wall 100.

The open right hand end of the chamber 98 is provided with a nipple 102 which is press-fitted therein and which contains a tapered internal opening 104 which narrows down to the diameter of the internal opening of the supply line 40. An 'O' ring 107 is carried within an annular grove 108 formed about the outer periphery of the nipple, which serves to establish a fluid-tight seal between the internal wall of the chamber 98 and the nipple 102.

Figure 9:
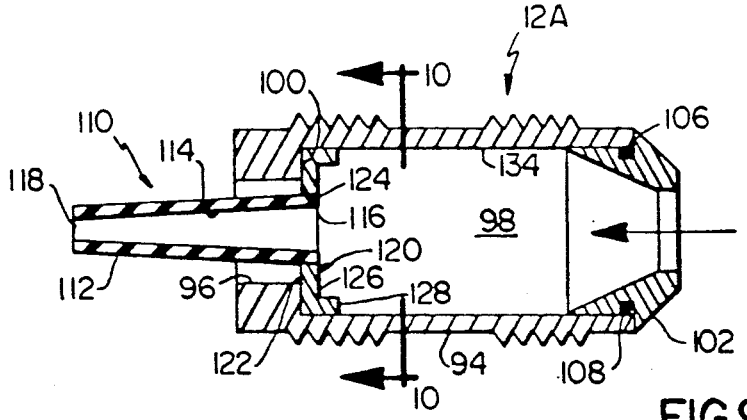
FIG. 9 is a longitudinal sectional view through a second embodiment of an expansion device according to the present invention.
Figure 12:
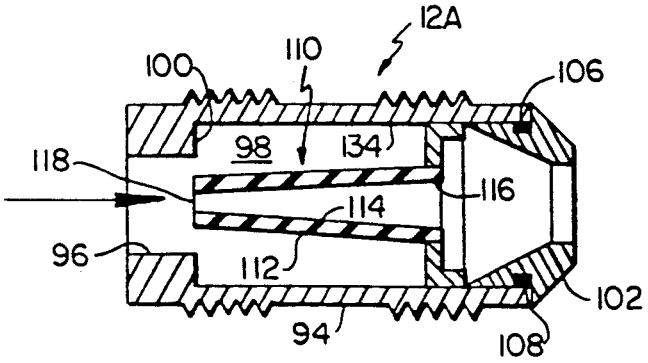
FIG. 12 is a longitudinal sectional view of the expansion device of FIG. 9 showing the device in the by-pass mode of operation.

A freely moving flow metering piston assembly 110 is slideably mounted within the expanded chamber 98. The flow metering piston assembly includes a longitudinally extending flow metering element 112 having a flow metering passage 114 extending longitudinally therethrough. As best seen in FIGS. 9 and 12 the flow metering passage 114 varies in cross sectional area from a maximum value at its inlet opening 116 to a minimum value at its outlet opening 118.

The flow metering element 112 is supported within the chamber 98 by a support and guide disc 120 which is attached to the flow metering element adjacent to the inlet opening 116. This support disc includes a circular planar portion 122 having a centrally located opening 124 therethrough for receiving and supporting the inlet end of the flow metering element 112.

Figure 10:
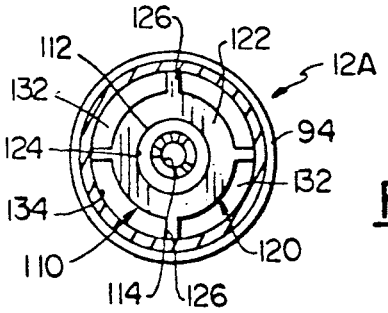
FIG. 10 is a sectional view of the second embodiment of the expansion device taken along the lines 10—10 of FIG. 9.

The diameter of the planar portion 122 of the guide disc is substantially less than the inside diameter of the chamber 98. Extending from the outer periphery of the planar portion 122 are a plurality of 'L' shaped legs each having a first section 126, substantially co-planar with the circular portion 122 and a second section 128 substantially perpendicular thereto. As best seen in FIG. 10 when the flow metering piston assembly 110 is mounted within the chamber 98, a plurality of arcuately shaped flow openings 132 are defined between the support disc 120 and the inner wall 134 of the chamber 98.

The 'L' shaped legs extend to the right as viewed in the drawing figures so that the left hand facing end face 130 of the planar end 122, is adapted to engage the right hand facing end wall 100 of the chamber 98 when the piston assembly is in its extreme left hand position. When so engaged the arcuate flow openings 132 are sealed against fluid flow therethrough. When the piston assembly 110 is in its extreme right hand position, as shown in FIG. 12, legs 128 of the disc 120 will engage, the left hand of the tapered opening 104 of the nipple 102.

As in the previously described embodiment, the flow metering element 112 is preferably made from a thermo setting material.

The thermo setting material is preferably formed in a mold which allows it to be cast directly to the opening 124 in the support disc 120 to thereby assure a fluid tight seal therebetween. In the illustrated embodiment a thin layer of the thermo setting material is also deposited on the outer surfaces of the support disc 120. The material is elastomeric in nature and is preferably a synthetic rubber which will remain dimensionally stable in a refrigerant environment.

In operation, variable area expansion valve 12A is installed in the refrigerant liquid line 40 in the system as shown in FIG. 1 to meter refrigerant as it moves at high pressure from heat exchanger 22, serving as a condenser coil, to heat exchanger 28, at low pressure serving as an evaporator. Under the influence of flowing refrigerant, the piston assembly 62 moves to the left to the position illustrated in FIG. 9. In this position the left hand end face 122 of the support disc 120 is in positive engagement with the right hand facing end wall 100 of the chamber 98. The flow openings 132 are thus sealed and the only flow path through the valve is the flow metering passage 114. As so positioned the flow metering element 112 will actually extend into the interior of the refrigerant line 40 on the low pressure side of the system.

FIG. 9 illustrates the valve 12A in a condition representing a relatively low pressure differential between the high and low pressure sides of the system. As shown, the high pressure portion of the refrigeration system comprises the portion of the valve to the right of the planar support disc 120. High pressure thus is in fluid communication with the inlet opening 116 of the flow metering passage 114 and the interior of the enlarged chamber 98, thus allowing access of high pressure refrigerant to the flow metering passage 66.

At the same time the pressure of the low pressure side of the refrigeration system is a fluid communication with the flow passage 96, the portion of the refrigerant line 40 which surrounds the flow metering element 112 and the outlet 118 of the flow metering passage 114.

Figure 11:
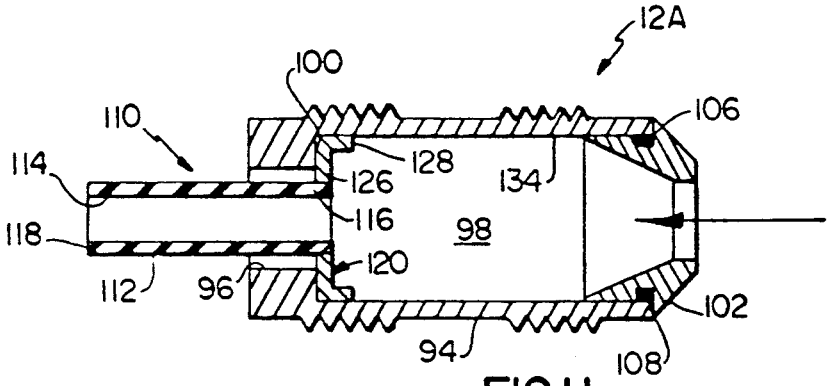
FIG. 11 is a longitudinal sectional view of the expansion device of FIG. 9 showing operation of the device while in the heating mode of operation.

As a result of this arrangement, as the pressure differential of the system increases the pressure within the flow metering passage 114 becomes increasingly larger than the pressure surrounding the flow metering element 112 and in fluid communication with the flow passage outlet 118. As a result, because of the elastomeric properties of this element, and the initial tapered configuration of the flow metering element 112, the unrestrained portion of the element will be caused to expand outwardly to thereby increase the effective of cross sectional area of the flow metering passage 114 extending therethrough. FIG. 11 represents the variable area expansion valve 12A operating at a relatively high system pressure differential. Comparison of FIG. 9

(high pressure differential) to FIG. 11 (low pressure differential) makes clear the substantially increased metering area through the valve during high pressure differential operation.

Referring now to FIG. 12, when the refrigeration cycle is reversed and refrigerant is caused to flow through the system in the opposite direction, the flow metering piston assembly 110 will automatically move to the position illustrated in FIG. 12 resting against the nipple 102. With the piston in this position there are two paths for refrigerant to flow through the valve past the flow metering element 112. A first path is through the flow metering passage 114, and, the second substantially larger cross sectional area path is through the plurality of flow openings 132 formed in the support disc 120. As a result, the flow through the valve 12A at this time is substantially unrestricted, around and through the metering assembly 110, to the downstream refrigerant line 40.

It should thus be appreciated that a refrigerant expansion device has been provided wherein the flow metering passage is formed in an elastomeric element and the elastomeric element is adapted to deform in response to an increased pressure differential across the expansion device to increase the size of the flow metering passage.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. A refrigerant expansion device for metering a flow of refrigerant between the high and low pressure sides of a refrigeration system comprising;

a housing having a flow passage extending therethrough;

a flow metering element having an outer wall and a flow metering passage extending longitudinally therethrough, said flow metering passage being defined by an inner wall of said flow metering element, and having an inlet opening at one end thereof and an outlet opening at the other end thereof, said flow metering element being formed from an elastomeric material;

means for supporting said flow metering element with respect to said flow passage of said housing with said inlet opening of said flow metering element in fluid communication with the high pressure side of the refrigeration system, and with said outer wall and said outlet opening of said flow metering element in fluid communication with the low pressure side of the refrigeration system; wherein said elastomeric flow metering element deforms in response to an increase in pressure differential between the high and low pressure sides of the refrigeration system to increase the size of said flow metering passage therethrough.

2. The apparatus of claim 1 wherein said flow metering passage varies in cross sectional area along its length.

3. The apparatus of claim 2 wherein said flow metering passage has a maximum cross sectional area at its inlet opening and a minimal cross sectional area at its outlet opening.

4. The apparatus of claim 2 wherein said flow metering passage has a minimum cross sectional area at a location therealong intermediate said inlet opening and said outlet opening.

5. The apparatus of claim 1 wherein said flow passage is defined in part by an inner wall, and, wherein said means for supporting comprises a disc means sealingly engaging the outer wall of said flow metering element adjacent said inlet opening, said disc having an opening therethrough in flow communication with said metering port, and, having an outer peripheral portion thereof in sealing engagement with said inner wall of said flow passage.

6. The apparatus of claim 5 wherein said flow metering passage varies in cross sectional area along its length.

7. The apparatus of claim 6 wherein said flow metering passage has a maximum cross sectional area at its inlet opening and a minimal cross sectional area at its outlet opening.

8. A refrigerant expansion device for metering a flow of refrigerant between high and low pressure sides of a refrigeration system comprising;

a housing having a flow passage extending therethrough, said flow passage being defined in part by an inner wall of said housing;

a flow metering element mounted within said flow passage, said flow metering element having an outer wall and a flow metering passage extending longitudinally therethrough, defined by an inner wall of said flow metering element, said metering element being formed from an elastomeric material;

means for coaxially supporting said flow metering element within said flow passage so that said inner wall of said housing and said outer wall of said metering element cooperate to define an annular cavity therebetween;

means for maintaining the pressure within said annular cavity at the pressure of the low pressure side of the refrigeration system; and means for preventing the flow of refrigerant through said cavity.

9. The apparatus of claim 8 wherein said elastomeric flow metering element deforms in response to an increase in pressure differential between the high and low pressure sides of the refrigeration system to increase the size of said flow metering port therethrough.

10. The apparatus of claim 9 wherein said flow metering passage has an inlet opening in fluid communication with the high pressure side of the refrigeration system and an outlet opening in fluid communication with the low pressure side of the refrigeration system, and, wherein said flow metering passage varies in cross sectional area along its length.

11. The apparatus of claim 10 wherein said flow metering passage has a minimum cross sectional area at a location therealong intermediate said inlet opening and said outlet opening.

12. A refrigerant expansion device for metering a flow of refrigerant between high and low pressure sides of a refrigeration system comprising;

a housing having a flow passage extending therethrough, said flow passage being defined in part by an inner wall of said housing, said housing having a first stop means within said flow passage, adjacent the end of said expansion device which is adapted to be connected to the low pressure side of the refrigeration system; said housing having a second stop means within said flow passage, adjacent to the end of said expansion device adapted to be connected to the high pressure of the refrigeration system; said first stop means, and said second stop means, and, said inner wall of said housing together defining a chamber within said flow passage;

a flow metering piston assembly, mounted within said chamber; said piston assembly including;

a flow metering element having an outer wall and a flow metering passage extending longitudinally therethrough, said flow metering passage being defined by an inner wall of said flow metering element, and having an inlet opening at one end thereof and an outlet opening at the other end thereof, said flow metering element being formed from an elastomeric material;

first and second support means located at opposite ends of said flow metering element; each of said support means sealingly engaging the outer wall of said flow metering element, and having a centrally positioned opening therethrough in flow communication with said metering passage, said first and second support means coaxially supporting said flow metering element within said chamber so that said inner wall of said chamber and said outer wall of said flow metering element cooperate to define an annular cavity therebetween, each of said first and second support means having at least one axially extending flow opening formed therein capable of allowing a flow of refrigerant therethrough;

said first support means engaging said flow metering element adjacent said outlet opening of said flow metering passage;

said second support means engaging said flow metering element adjacent said inlet opening of said flow metering passage, said second support means having a valve means for preventing flow through said at least one flow opening when refrigerant is flowing from the high pressure side to the low pressure side of the refrigeration system, and for allowing substantially unrestricted flow through said at least one opening when refrigerant is flowing in the other direction;

whereby, when refrigerant is flowing through the device in the direction from the high pressure side to the low pressure side of the refrigeration system, said valve means of said second support means operates to prevent flow of refrigerant through said at least one flow passage of said second support means and high pressure refrigerant is in fluid communication with said inlet opening of said flow metering passage to allow the metering of refrigerant through said flow metering passage, and, wherein the low pressure side of the refrigeration system is in fluid communication with said annular cavity through said at least one flow opening in said first support means;

said flow metering piston assembly allowing free flow of refrigerant through said flow openings in both said first and second support means when the flow of refrigerant through said device is in the opposite direction.

13. The apparatus of claim 12 wherein said flow metering passage varies in cross sectional area along its length.

14. The apparatus of claim 13 wherein said flow metering passage is in minimum cross sectional area at a location therealong intermediate said inlet opening and said outlet opening.

* * * * *